United States Patent [19]

Wegener et al.

[11] 4,234,444

[45] Nov. 18, 1980

[54] NONIONIC TENSIDE DETERGENT COMPOSITIONS

[75] Inventors: Ingo Wegener, Düsseldorf; Johann Glasl, Solingen; Achim Werdehausen, Haan, all of Fed. Rep. of Germany

[73] Assignee: Henkel Kommanditgesellschaft auf Aktien, Düsseldorf-Holthausen, Fed. Rep. of Germany

[21] Appl. No.: 51,542

[22] Filed: Jun. 25, 1979

[30] Foreign Application Priority Data

Jul. 6, 1978 [DE] Fed. Rep. of Germany ..... 2829697

[51] Int. Cl.[3] ..... C11D 1/72; C11D 1/66

[52] U.S. Cl. ..... 252/174.22; 252/174.19; 252/174.21; 568/680; 260/458 R

[58] Field of Search ..... 252/174.22, 174.21, 252/174.19; 568/680; 260/458 R

[56] References Cited

U.S. PATENT DOCUMENTS

| | | | |
|---|---|---|---|
| 3,682,849 | 8/1972 | Smith | 252/174.21 |
| 3,707,506 | 12/1972 | Lozo | 252/174.22 |
| 3,882,038 | 5/1975 | Clayton | 252/174.21 |
| 3,931,338 | 1/1976 | Rupilius | 568/680 |
| 3,933,923 | 1/1976 | Osberghaw | 568/680 |

*Primary Examiner*—Mayer Weinblatt

*Attorney, Agent, or Firm*—Hammond & Littell, Weissenberger & Muserlian

[57] ABSTRACT

This invention relates to a detergent composition comprising:

(a) from about 40 to 60% by weight of compounds of formula $$R^1—O—(CH_2CH_2O)_n—H \quad (I)$$

wherein $R^1$ represents a saturated or unsaturated aliphatic radical of a fatty alcohol having from about 6 to 18 carbon atoms, and n is an integer of from 4 to 15; and (b) from about 60 to 40% by weight of compounds of formula $$\begin{array}{ccc} & R^2—CH—CH—R^3 & \\ & \quad\;\; | \qquad\;\; | & \\ H—(OCH_2CH_2)_p—O & & O—(CH_2CH_2O)_q—H \end{array} \quad (II)$$

wherein $R^2$ and $R^3$ each independently represent an alkyl radical having from about 1 to 17 carbon atoms, the total number of carbon atoms in $R^2$ and $R^3$ being from about 8 to 18, and p and q each independently represent a number from 0 to 15, the sum of p and q being from about 4 to 15.

2 Claims, No Drawings

NONIONIC TENSIDE DETERGENT COMPOSITIONS

FIELD OF THE INVENTION

This invention relates to detergent compositions. More particularly, this invention relates to detergent compositions comprised of nonionic tensides.

BACKGROUND OF THE INVENTION

Addition products of ethylene oxide to fatty alcohols possess detergent properties and are widely used. However, these products are not satisfactory since they are difficult to pour in the temperature range from 5° to 20° C. because of their high viscosity. Attempting to reduce the viscosity of the products by dilution with water has led to an undesirable gel formation in most cases.

It has been suggested in German Published Application (DOS) No. 22 05 337 that these disadvantageous characteristics can be avoided by adding an anionic surface-active compound or tenside in an amount of from 1 to 10% by weight, based on the total weight of the detergent mixture, to the condensation products of ethylene oxide and linear fatty alcohols. This approach has the disadvantage that the characteristic of the nonionic tensides or surface-active compounds is changed completely by the addition of anionic tensides shifting the turbidity points of the nonionic ethylene oxide addition products strongly toward higher temperatures or causing their complete disappearance.

Detergent compositions comprising addition products of ethylene oxide to fatty alcohols have now been found that, like the known mixtures with anionic tensides, have a lower viscosity at room temperature, but do not exhibit the disadvantages of the latter. The new compositions contain addition products of ethylene oxide to nonterminal vicinal alkane diols.

OBJECTS OF THE INVENTION

It is an object of this invention to provide detergent compositions comprised of a mixture of nonionic tensides.

It is also an object of this invention to provide detergent compositions having improved viscosity characteristics.

These and other objects of the invention will become more apparent in the discussion below.

DETAILED DESCRIPTION OF THE INVENTION

This invention relates to detergent compositions comprising:

(a) from about 40 to 60% by weight of compounds of formula $$R^1—O—(CH_2CH_2O)_n—H \quad (I)$$

wherein $R^1$ represents a saturated or unsaturated aliphatic radical of a fatty alcohol having from about 6 to 18 carbon atoms, and n is an integer of from 4 to 15; and (b) from about 60 to 40% by weight of compounds of formula $$\begin{array}{c} R^2—CH—CH—R^3 \\ \quad\quad\;\; | \quad\quad\; | \\ H—(OCH_2CH_2)_p—O \quad O—(CH_2CH_2)_q—H \end{array} \quad (II)$$

wherein $R^2$ and $R^3$ each independently represent an alkyl radical having from about 1 to 17 carbon atoms, the total number of carbon atoms in $R^2$ and $R^3$ being from about 8 to 18, and p and q each independently represent a number from 0 to 15, the sum of p and q being from about 4 to 15.

The compounds of Formula I are known substances that can be obtained by known processes. Starting materials for their preparation may be saturated and unsaturated fatty, i.e., long chain, alcohols, particularly alkanols and alkenols, having from about 6 to 18 carbon atoms, such as n-hexanol, n-octanol, n-decanol, n-dodecanol, n-tetradecanol, n-hexadecanol, n-octadecanol and 9-octadecenol-(1). Typically, however, mixtures of fatty alcohols, such as those obtained by sodium reduction or catalytic hydrogenation of fatty acid mixtures from the hydrolytic saponification of native fats and oils, are used for the synthesis of these compounds. Examples of such mixtures of fatty alcohols include the technical grade fatty alcohols from coconut, palm kernel, tallow, soybean, and linseed oil. The fatty alcohols or mixtures of fatty alcohols are reacted with a corresponding amount of ethylene oxide, in the presence of suitable alkoxylating catalysts, at elevated temperature and increased pressure.

The compounds of Formula II are also known substances. They can be obtained by known processes, by addition of the respective amount of ethylene oxide to alkane diols having vicinal, nonterminal hydroxyl groups and from about 10 to 20 carbon atoms. Preferably, mixtures of alkane diols of varying chain length or those with vicinal hydroxyl groups in isomeric positions, or both, are used for preparation of the compounds of Formula II. Such mixtures of alkane diols can be obtained in a known manner from olefins and olefin mixtures having nonterminal double bonds randomly distributed over the hydrocarbon chain, by epoxidation and subsequent hydrolysis of the resulting epoxyalkanes.

Useful olefins and olefin mixtures can be obtained by, for example, the catalytic dehydration or chlorination/-dehydrochlorination of linear paraffins having a desired chain length and by subsequent selective extraction of the monoolefins with nonterminal double bonds. These olefins and olefin mixtures are epoxidated by known processes, for example, with peracetic acid. The hydrolysis of the epoxyalkanes is also perfomed according to processses known from the literature, with the method described in U.S. Pat. No. 3,933,923 having been found to be especially advantageous. According to this process, the epoxyalkanes are hydrolyzed with 1 to 20% by weight aqueous solutions of salts of aliphatic mono- and/or polycarboxylic acids at temperatures above 100° C. and up to 300° C. Especially suitable for this reaction are the alkali metal salts, particularly the sodium salts of acetic acid, propionic acid, butyric acid, caproic acid, caprylic acid, and pelargonic acid. Salts of dicarboxylic acids such as malonic acid, succinic acid, adipic acid, maleic acid, fumaric acid, azelaic acid, and sebacic acid, are preferred. Mixtures of salts of mono- and dicarboxylic acids may also be used.

The proportions of epoxide to be hydrolyzed and salt solution should amount to at least 0.5 parts by weight salt solution per part by weight epoxide. The use of from about 2 to 5 parts by weight salt solution per part by weight epoxide was found to be advantageous.

Preferably the hydrolysis is performed in the presence of a solvent such as acetone, dioxane, or dioxolane.

The solvents are used in amounts of at least 0.5 parts by weight per part by weight of the epoxide to be hydrolyzed. It is especially preferable to use solvent in a weight ratio of 2:1.

The reaction can be performed so that the mixture of epoxide, salt solution and, if desired, solvent, is heated with stirring in an autoclave to the respective reaction temperature and kept at this temperature until the hydrolysis is completed. Reaction times of 15 minutes to 2 hours generally are adequate for this. After the removal by distillation of any solvent present, the reaction mixture can be recovered simply by phase-separation with warming.

Suitable starting material for the preparation of compounds of Formula II include, for example, a mixture of isomeric vicinal alkane diols having a $C_{10}$ chain length and nonterminal hydroxyl groups; a mixture of isomeric vicinal alkane diols having a $C_{18}$ chain length and nonterminal hydroxyl groups; a mixture of isomeric vicinal alkane diols having $C_{11}$–$C_{15}$ chain length and nonterminal hydroxyl groups; a mixture of isomeric vicinal alkane diols having $C_{14}$–$C_{16}$ chain length and nonterminal hydroxyl groups; and a mixture of vicinal alkane diols having $C_{15}$–$C_{18}$ chain length and nonterminal hydroxyl groups.

The above-described alkane diol mixtures are reacted with a corresponding amount of ethylene oxide in the presence of suitably alkoxylating catalysts, at elevated temperature and increased pressure, for the preparation of the compounds of Formula II. The compounds prepared are generally semisolid to solid, wax-like products.

Another method of preparing the compounds of Formula II comprises the reaction of the above-described epoxyalkanes with ethylene glycol and the subsequent ethoxylation of the obtained vicinal hydroxy-hydroxyethoxyalkane. In this method, the epoxides obtained from olefin mixtures are reacted in a known manner in the presence of acid alkoxylating catalysts at elevated temperature and, if desired, increased pressure, with an excess of ethylene glycol. In an especially advantageous method described in U.S. Pat. No. 3,931,338, the reaction is carried out in the presence of an alkane, such as, for example, pentane, hexane, heptane, or octane. After the separation of any solvent present and excess ethylene glycol, the obtained reaction products are further reacted at elevated temperature and increased pressure in the presence of suitable alkoxylating catalysts, with a corresponding amount of ethylene oxide, to form the compounds of Formula II. The products prepared in this manner are also semisolid to solid, wax-like products.

Detergent compositions with especially advantageous characteristics with respect to applied technology are obtained when the compounds of Formula I and Formula II used for their preparation are similarly hydrophilic. Therefore, detergent compositions in which the difference between n in Formula I and the sum of p and q in Formula II is equal to or less than 2, represent a preferred embodiment of the invention.

For the preparation of the detergent compositions according to the invention, the compounds of Formula I and II are mixed with one another in the desired proportions, with the aid of an agitator or kneading machine.

EXAMPLES

The following examples illustrate the invention and are not to be construed as limiting the invention thereto.

EXAMPLE 1

Fifty parts by weight of the addition product of 10 mols ethylene oxide to a mixture of fatty alcohols of coconut oil with the chain length $C_{12}$–$C_{18}$ (OH-number261), were mixed at room temperature, using a wing agitator aggregate with attached baffle, with 50 parts by weight of a product that had been prepared by the reaction of an epoxyalkane mixture of the chain length $C_{11}$–$C_{14}$ and with nonterminal epoxy groups (7.48% by weight epoxide oxygen) with ethylene glycol, and the subsequent addition of 10 mols of ethylene oxide. The obtained detergent mixture was liquid and dissolved spontaneously in water. No gel formation was observed upon the addition of water.

When the dissolution of the fatty alcohol/ethylene oxide adduct in water was attempted without any additional substance, the result was a gel that could not be poured.

EXAMPLE 2

Fifty-five parts by weight of an addition product of 5 mols ethylene oxide to a mixture of fatty alcohols of coconut oil with the chain length $C_{12}$–$C_{18}$ (OH-number 261), were mixed as in Example 1, with 45 parts by weight of a product that had been obtained by addition of 5 mols of ethylene oxide to an alkane diol mixture with the chain length $C_{15}$–$C_{18}$ and vicinal nonterminal hydroxyl groups (OH-number 418). The resulting detergent mixture was liquid and dissolved spontaneously in water, without the formation of gel.

A gel that could not be poured resulted from the mixing of the fatty alcohol/ethylene oxide mixture alone, with water.

EXAMPLE 3

Sixty parts by weight of an addition product of 5 mols of ethylene oxide to a mixture of fatty alcohols of tallow oil with the chain length $C_{14}$–$C_{18}$ (OH-number 216), were mixed, as in Example 1, with 40 parts by weight of a product that had been obtained by the reaction of an epoxyalkane mixture with the chain length $C_{15}$–$C_{18}$ and nonterminal epoxy groups (5.35% by weight epoxy oxygen) with ethylene glycol and subsequent addition of 5 mols of ethylene oxide. The resulting detergent mixture was liquid but slightly turbid. It dissolved without difficulty in water to form a clear solution.

The mixing with water of the adduct of fatty alcohol of tallow oil to ethylene oxide alone, led to the formation of a gel that could not be poured.

EXAMPLE 4

Fifty parts by weight of an addition product of 12 mols of ethylene oxide to an oleyl-cetyl alcohol mixture (OH-number 216; iodine-number 65) were mixed, as in Example 1, with fifty parts by weight of a product that had been obtained by the reaction of an epoxyalkane mixture with the chain length $C_{16}$–$C_{18}$ and nonterminal epoxy groups (5.75% by weight epoxide oxygen) with ethylene glycol and subsequent adddition of 10 mols of ethylene oxide. A liquid product was obtained, which dissolved spontaneously in water, without troublesome gel formation.

When the oleyl-cetyl alcohol/ethylene oxide adduct was mixed with water without any additional substance, the result was a gel that could not be poured.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

We claim:

1. A detergent composition consisting essentially of (a) from about 40 to 60% by weight of compounds of formula $$R^1-O-(CH_2CH_2O)_n-H \quad (I)$$

wherein $R^1$ represents a saturated or unsaturated radical of a fatty alcohol having from about 6 to 18 carbon atoms, and n is an integer of from 4 to 15; and (b) from about 60 to 40% by weight of compounds of formula $$\begin{array}{ccccc} & & R^2-CH & -CH-R^3 & \\ & & | & | & \\ H-(OCH_2CH_2)_p & -O & & O-(CH_2CH_2O)_q & -H \end{array} \quad (II)$$

wherein $R^2$ and $R^3$ each independently represent an alkyl radical having from about 1 to 17 carbon atoms, the total number of carbon atoms in $R^2$ and $R^3$ being from about 8 to 18, and p and q each independently represent a number from 0 to 15, the sum of p plus q being from about 4 to 15.

2. The detergent composition of claim 1 wherein the difference between n of Formula I and the sum of p+q in Formula II is equal to or less than 2.

* * * * *